US006230391B1

(12) United States Patent
Chilton et al.

(10) Patent No.: US 6,230,391 B1
(45) Date of Patent: May 15, 2001

(54) INSULATOR INSERTION TOOL AND KIT

(75) Inventors: Robert Joseph Chilton, Fort Washington, PA (US); Livia N. McCleary, Cherry Hill, NJ (US); William Henry Segarra, Linwood, PA (US)

(73) Assignee: General Instrument Corporation, Horsham, PA (US)

( * ) Notice: Subject to any disclaimer, the term of this patent is extended or adjusted under 35 U.S.C. 154(b) by 0 days.

(21) Appl. No.: 09/138,500

(22) Filed: Aug. 24, 1998

(51) Int. Cl.[7] ..... H01H 69/02

(52) U.S. Cl. ..... 29/623; 29/845; 29/278; 29/270; 29/750

(58) Field of Search ..... 29/278, 280, 282, 29/750, 752, 767, 270, 245; 254/270, 278, 780, 282

(56) References Cited

U.S. PATENT DOCUMENTS

| | | | | |
|---|---|---|---|---|
| 2,853,772 | * | 9/1958 | Yuter | 29/278 |
| 3,052,970 | * | 9/1962 | Perrin | 29/229 |
| 3,074,155 | * | 1/1963 | Cootes et al. | 29/206 |
| 3,132,289 | | 5/1964 | Russo | 317/108 |
| 3,134,931 | | 5/1964 | Kobryner | 317/104 |
| 3,171,909 | | 3/1965 | Foskett | 200/511 |
| 3,617,811 | | 11/1971 | McVoy | 317/99 |
| 3,643,209 | | 2/1972 | Coston | 339/155 R |
| 3,764,956 | | 10/1973 | Norden | 339/74 R |
| 3,768,063 | | 10/1973 | Coffman | 339/31 R |
| 3,881,160 | | 4/1975 | Ross | 333/8 |
| 3,895,318 | | 7/1975 | Ross | 333/6 |
| 3,914,564 | | 10/1975 | Reed et al. | 200/51 |
| 3,962,160 | | 6/1976 | Reed et al. | 317/108 |
| 4,388,670 | | 6/1983 | Billhartz | 361/367 |
| 4,660,921 | | 4/1987 | Hauver | 339/177 R |
| 4,755,776 | | 7/1988 | Preschutti | 333/100 |
| 4,825,021 | | 4/1989 | Pauza | 200/504 |
| 5,161,301 | * | 11/1992 | Kilsodonk | 29/739 |
| 5,305,017 | * | 4/1994 | Gerpheide | 345/174 |
| 5,469,613 | * | 11/1995 | McMills et al. | 29/751 |
| 5,648,745 | | 7/1997 | Spriester et al. | 333/100 |
| 5,655,294 | * | 8/1997 | Makino | 29/845 |
| 5,756,935 | | 5/1998 | Balanovsky et al. | 174/52.1 |
| 5,794,997 | * | 8/1998 | Lewton, Jr. | 294/15 |
| 5,904,711 | * | 5/1999 | Flom et al. | 607/129 |

* cited by examiner

*Primary Examiner*—Lee Young
*Assistant Examiner*—Sean Smith
(74) *Attorney, Agent, or Firm*—Volpe and Koenig, P.C.

(57) ABSTRACT

A kit and method for minimizing the chance of a short circuit during servicing of a signal tap. The kit includes a pair of insertion tools. Each insertion tool includes a shaft dimensioned to be received within a plug port of the tap and a slot extending along its length. The kit further includes a pair of external insulator strips, each having an insertion portion configured to be positionable within the shaft slot. To prepare the tap for servicing, each insertion tool is positioned in a respective plug port. An external insulator strip is positioned in and moved along the respective slot to a position that isolates the contact terminals and reduces the risk of a short circuit. In taps including an internal bypass switch, the kit may further include a pair of internal insulator strips which are positioned between the bypass switch ends and the tap housing.

21 Claims, 11 Drawing Sheets

INSULATOR INSERTION TOOL AND KIT

BACKGROUND OF THE INVENTION

1. Field of the Invention

The present invention relates to cable television transmission components. More particularly, the invention relates to an apparatus used in conjunction with a bypass system for a cable television tap. The apparatus minimizes interruption of the cable signal to downstream subscribers and the chance of a short circuit in the system during servicing of the cable television tap.

2. Description of Related Art

Cable television (CATV) services are provided to subscribers through transmission networks that include taps, splitters, amplifiers and other equipment that distribute CATV service and ensure that the CATV signal quality is maintained. In particular, taps reside along the network to provide access outlets for localized subscribers. CATV network and service as used herein refers to all systems involving the transmission of television signals from the headend over a transmission medium, such as fiber optic cable or coaxial cable.

FIG. 1 is a block diagram of a CATV network 5. The transmission line 34 provides cable signals from the headend 32 to subscribers 38, 39 at remote locations. The subscribers 38, 39 receive signals through taps 36, 37 placed along the transmission line 34. The CATV signals are typically routed into the tap and through a printed circuit board attached to the tap cover which splits the signal and allows each tap 36, 37 to typically provide a connection to four or more subscribers.

Referring to FIG. 2, a prior art CATV multiple tap 15 is shown. The multiple tap 15 generally includes a tap cover 10, a printed circuit board 14, a pair of terminal housings 40 and a main housing 26. The tap cover 10 is provided with a plurality of tap outlets 12, each of which provides CATV service to a different subscriber. The printed circuit board 14 is rigidly attached to the inside surface of the cover 10 and includes a pair of signal receptors 22, 23. The signal receptors 22, 23 allow the signal to flow through the printed circuit board 14 and to be split among the subscribers fed from the tap outlets 12. The signal also passes through the tap 15 to a downstream tap 37. A detailed explanation of the function of the printed circuit board 14, which is well known to those skilled in the art, is outside the scope of the present invention. A metal braid 11 surrounds the periphery of the printed circuit board 14 at the junction between the cover 10 and the main housing 26. The metal braid 11 provides an EMI/RFI trap for the printed circuit board 14.

The main housing 26 includes threaded signal ports 24, 25 at opposing ends. The input signal port 24 is adapted to receive a signal input via a coaxial cable and a signal impact connector 50. The output signal port 25 receives a signal output connector 51 for outputting the received signal to the downstream CATV network. The internal conductor 52, 53 of each coaxial cable 50, 51 is connected inside the tap 15 at a terminal housing 40. A threaded plug port 27 is provided adjacent to each signal port 24, 25 to allow plugs 28 to be removed. Exposed terminal screws 46 aligned with the ports 27 are tightened onto the conductors 52, 53 to fix each to a contact terminal 42 positioned in the respective terminal housing 40 (see FIG. 5). The components of the terminal housing 40 are shown in greater detail in FIG. 4. Upon engagement of the cover 10, the receptors 22, 23 on the printed circuit board 14 engage the contact terminals 42 to complete the circuit.

Referring to FIG. 3, the uninterrupted signal path 16 for the CATV tap 15 is illustrated. When the cover 10 is installed, the signal, shown as line 16, originates from the signal input connector 50. The signal input conductor 52 contacts the contact terminal 42 within the first terminal housing 40 and the signal flows through the contact terminal 42 to the first signal receptor 22 on the printed circuit board 14. The signal then flows through the printed circuit board 14 (and thus to each individual tap 12) and to the second signal receptor 23. The second signal receptor 23 is coupled to the second contact terminal 42 within the other terminal housing 40 which contacts the conductor 53 within signal output connector 51.

Periodically, the taps 36, 37 require servicing due to malfunctioning of the tap 36, 37 or to connect or disconnect subscribers 38, 39. However, when the cover 10 is removed for servicing the tap 15, the printed circuit board 14 is also removed and the signal path is open-circuited since the signal receptors 22, 23 no longer are connected to the contact terminals 42. As a result, removal of the cover results in interruption of the cable signal over the transmission line 34 to subscribers downstream from that tap. For example, returning to FIG. 1, servicing of the tap 36 not only results in interruption of service to the subscribers 38 who are fed from that tap 36, but also subscribers 39 who access the CATV network 5 through the downstream tap 37. Various systems have been developed in attempts to reduce and eliminate interrupted service to downstream subscribers when the cover of the tap is removed for servicing.

One system for providing uninterrupted downstream service during servicing of a tap device is described in detail in U.S. Pat. No. 5,756,935 which issued May 26, 1998 and is commonly assigned with the present invention. This system provides an internal bypass switch 60 which maintains signal flow when the cover 10 is removed. The bypass switch 60 includes a flexible leaf spring bypass conductor 62. As shown in FIG. 6, removal of the tap cover 10 causes the conductor 62 to automatically contact both contact terminals 42 to thereby maintain uninterrupted service to downstream subscribers. When the tap cover 10 is replaced, see FIG. 7, an actuator 64 disengages and grounds the leaf spring bypass conductor 62 and the signal again flows through the printed circuit board 14.

One problem which occasionally occurs with this type of bypass switch 60 is a short circuit. With the tap cover 10 in place, both ends 63 of the bypass conductor 62 are grounded against the tap housing 26. As the tap cover 10 is removed, one of the ends 63 of the bypass conductor 62 may move into contact with its respective contact terminal 42 while the other end 63 is still grounded against the tap housing 26. This will generally result in a short circuit. Since it may difficult for a service technician to tell if a tap 15 which is about to be serviced includes a bypass switch 60, it is prudent to treat each tap 15 as if it has a bypass switch 60 with the potential for a short circuit.

Accordingly, it is an object of the invention to provide a bypass system which provides minimally interrupted service to downstream subscribers during removal of the tap cover for servicing while minimizing the chance of a short circuit.

SUMMARY OF THE INVENTION

The present invention generally relates to a kit for minimizing the chance of a short circuit during servicing of a signal tap and method of use therefor. The kit includes a pair of insertion tools, each with a shaft dimensioned to be received within a plug port of the tap. The shaft includes a slot extending along its length. The kit further includes a pair of external insulator strips, each having an insertion portion configured to be positionable within the shaft slot. To prepare the tap for servicing, each insertion tool is positioned in a respective plug port with one end adjacent the tap contact terminal. An external insulator strip is then positioned in and moved along the respective slot to a position that isolates the contact terminals and reduces the risk of a short circuit.

In taps including an internal bypass switch, the kit may further include a pair of internal insulator strips which are positioned between the bypass switch ends and the tap housing.

DETAILED DESCRIPTION OF THE PREFERRED EMBODIMENT

The preferred embodiment will be described with reference to drawing figures where the numerals represent like elements throughout.

Figure 1:
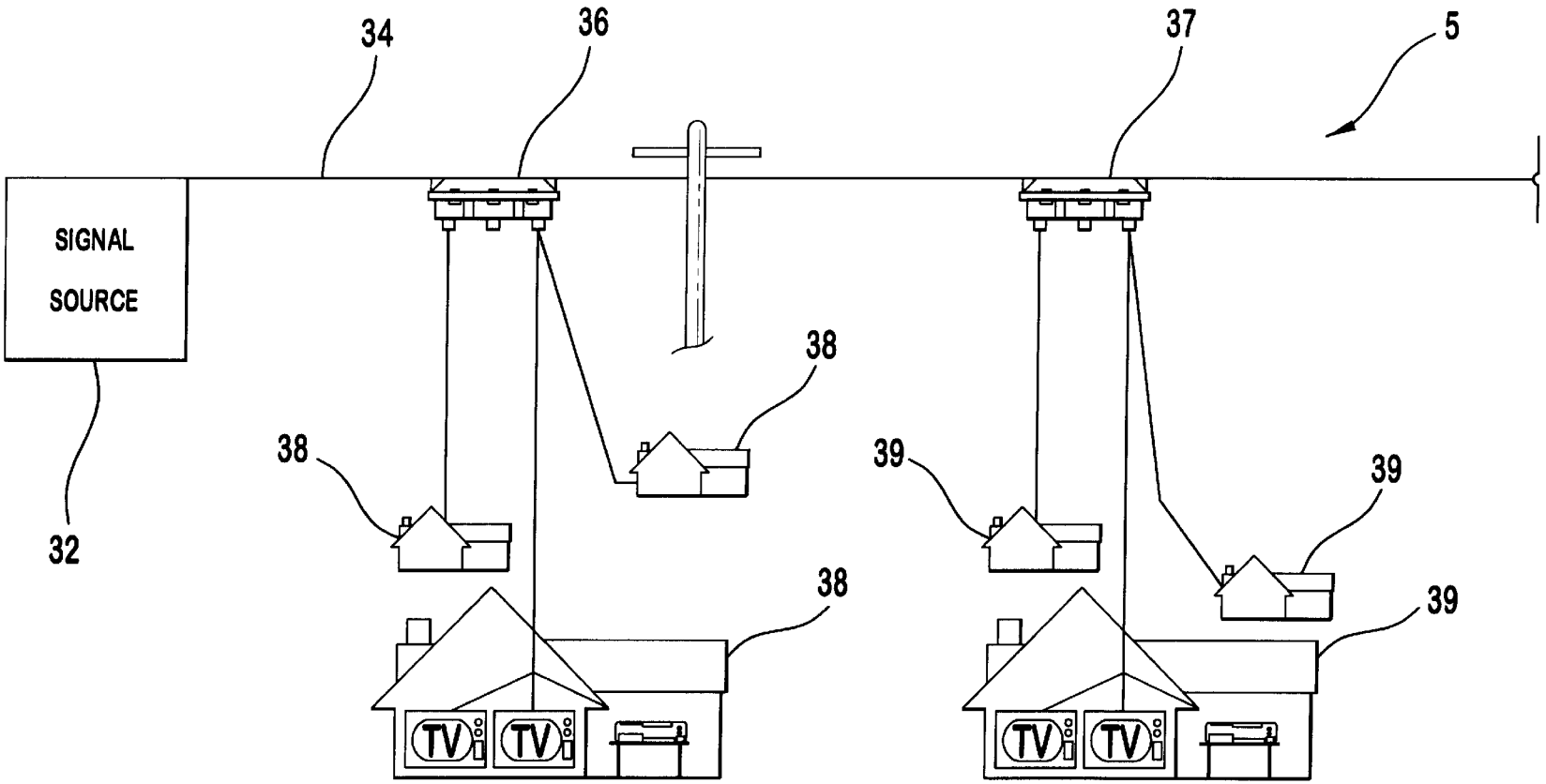
FIG. 1 is an overall system block diagram of a typical cable television system.
Figure 2:
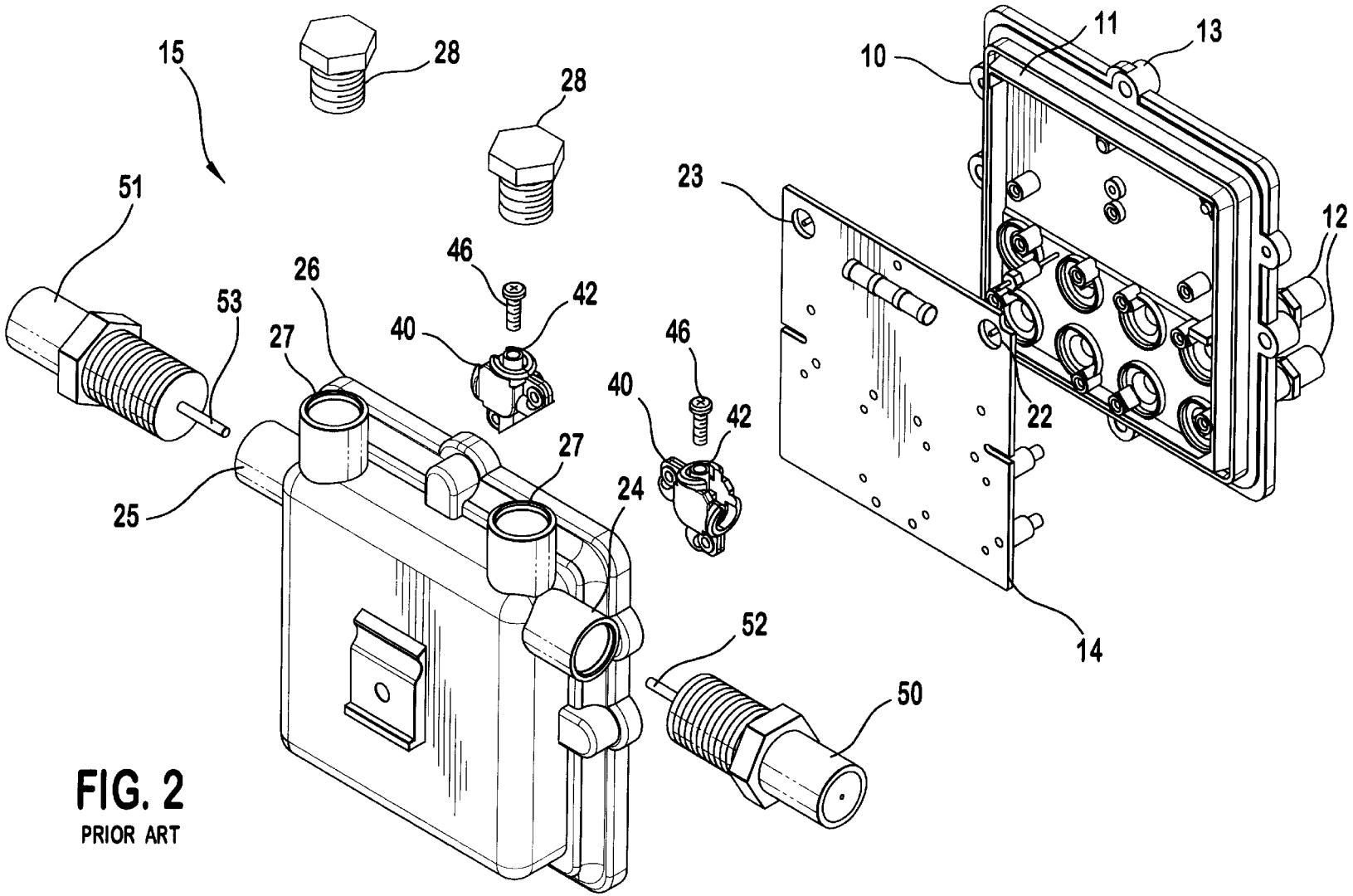
FIG. 2 PRIOR ART
FIG. 2 is a perspective view of a prior art cable tap.
Figure 3:
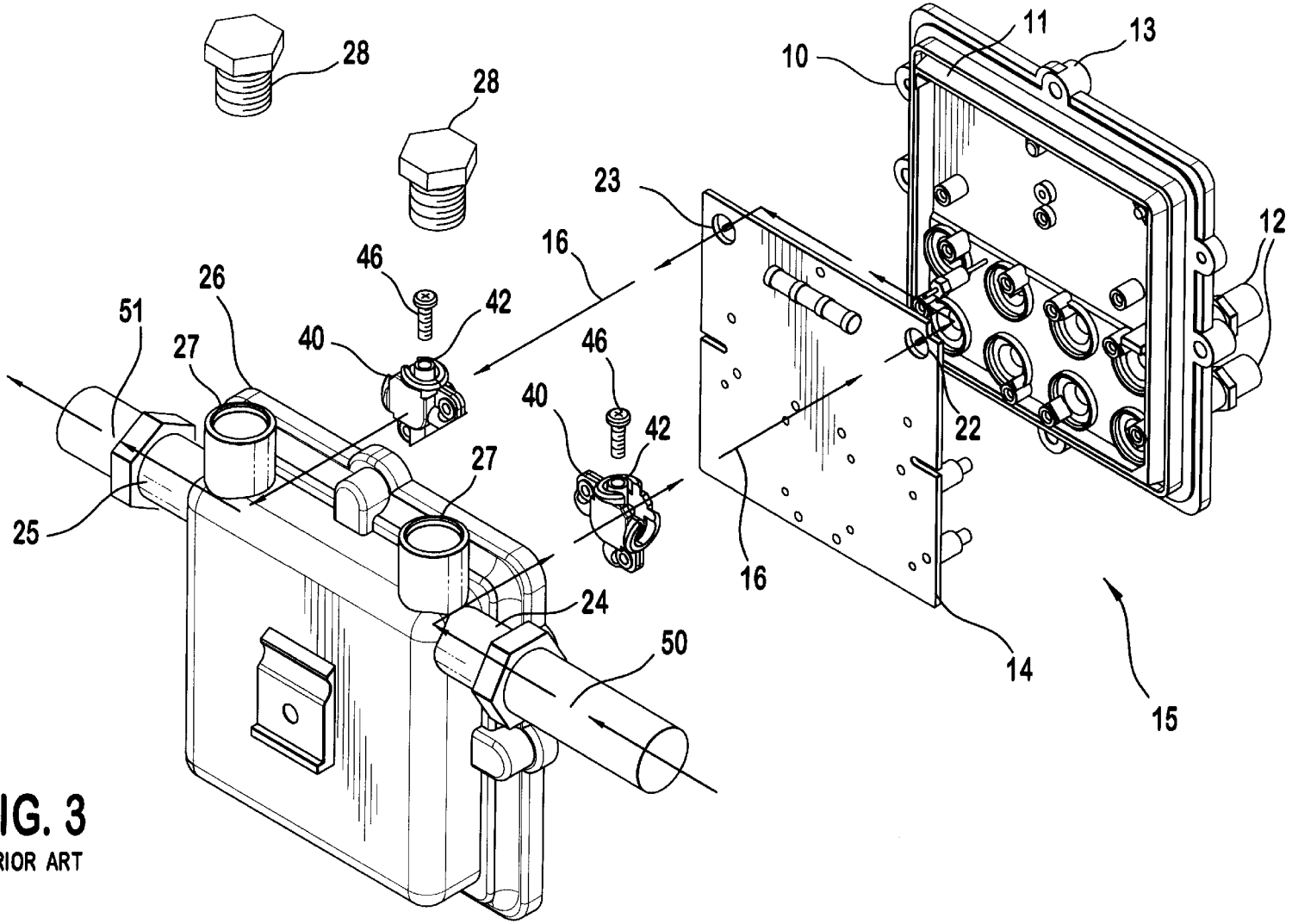
FIG. 3 PRIOR ART
FIG. 3 is a perspective view of the signal path through the prior art cable tap.
Figure 4:
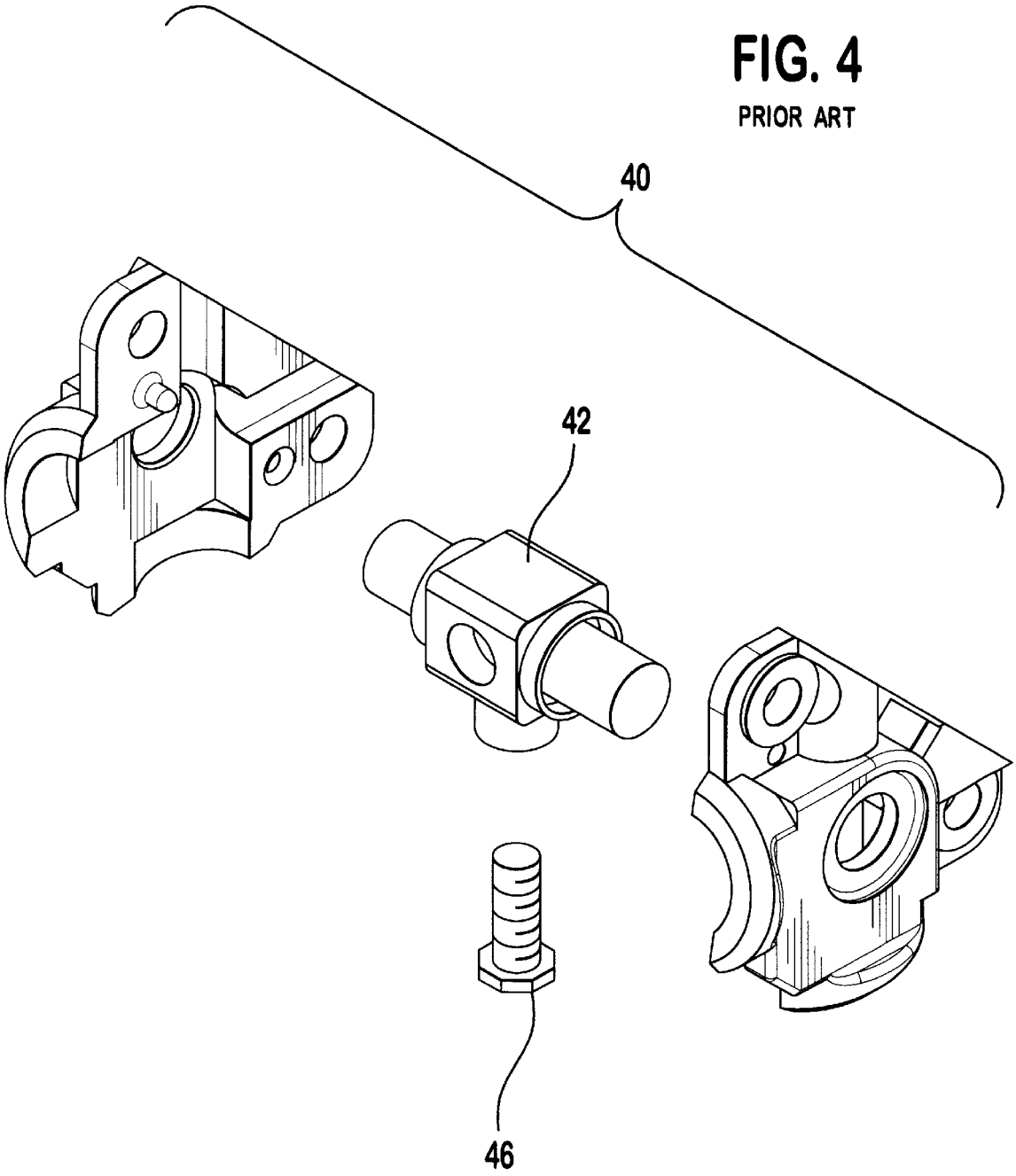
FIG. 4 PRIOR ART
FIG. 4 is a perspective view of a disassembled terminal housing.
Figure 5:
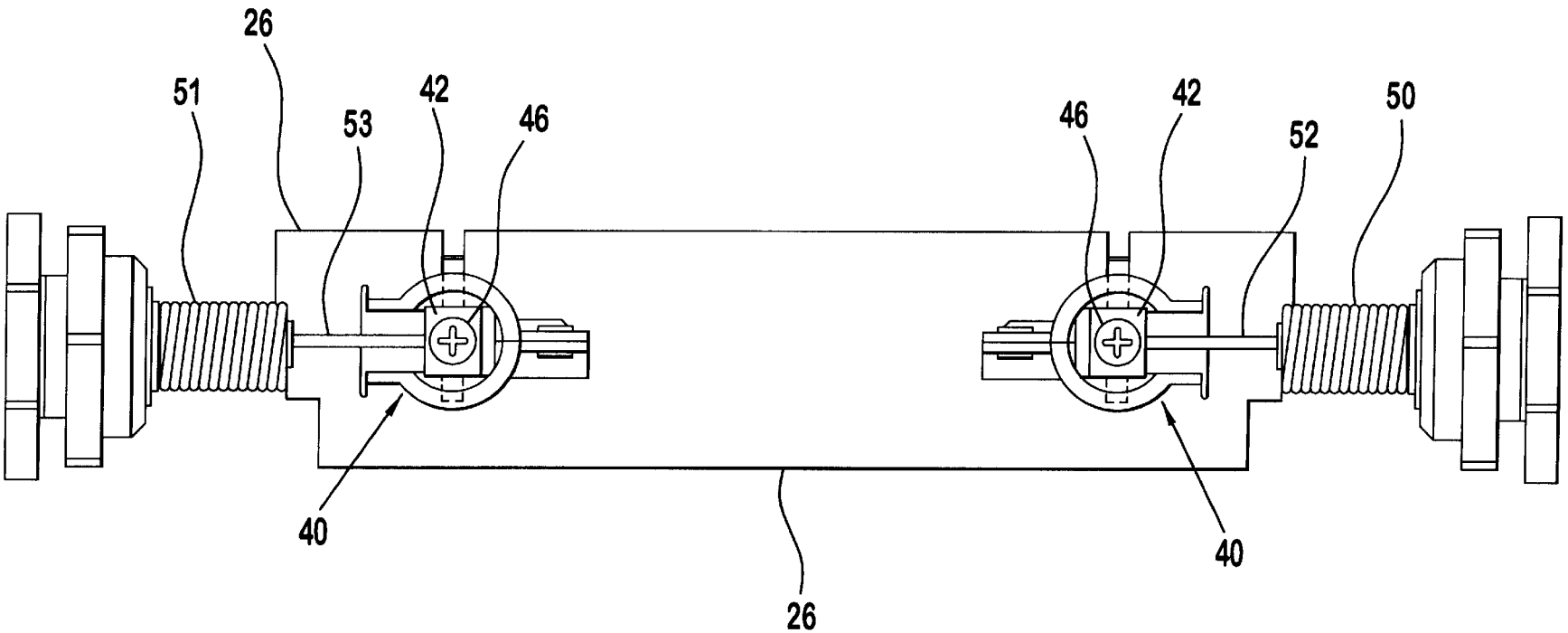
FIG. 5 PRIOR ART
FIG. 5 is a plan view of the cables being connected in the tap.
Figure 6:
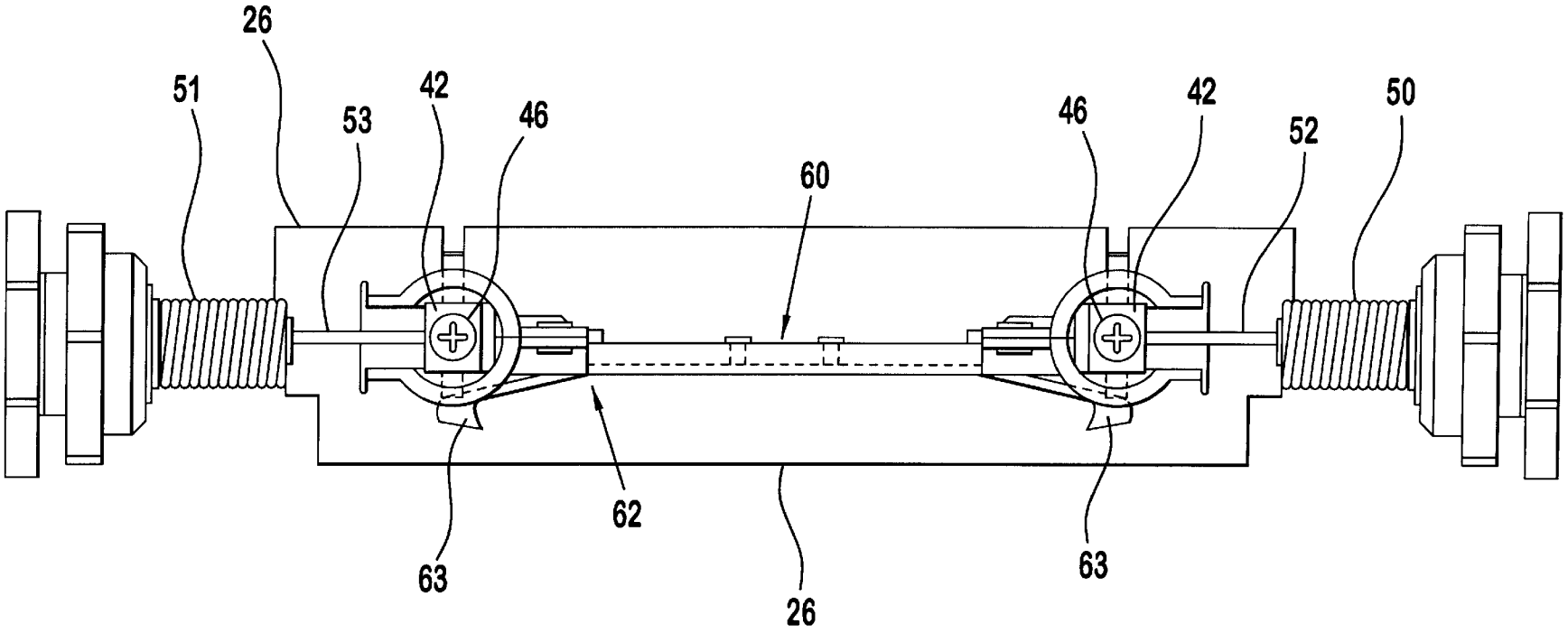
FIG. 6 PRIOR ART
FIG. 6 is a plan view of a tap having a bypass switch with the cover removed.
Figure 7:
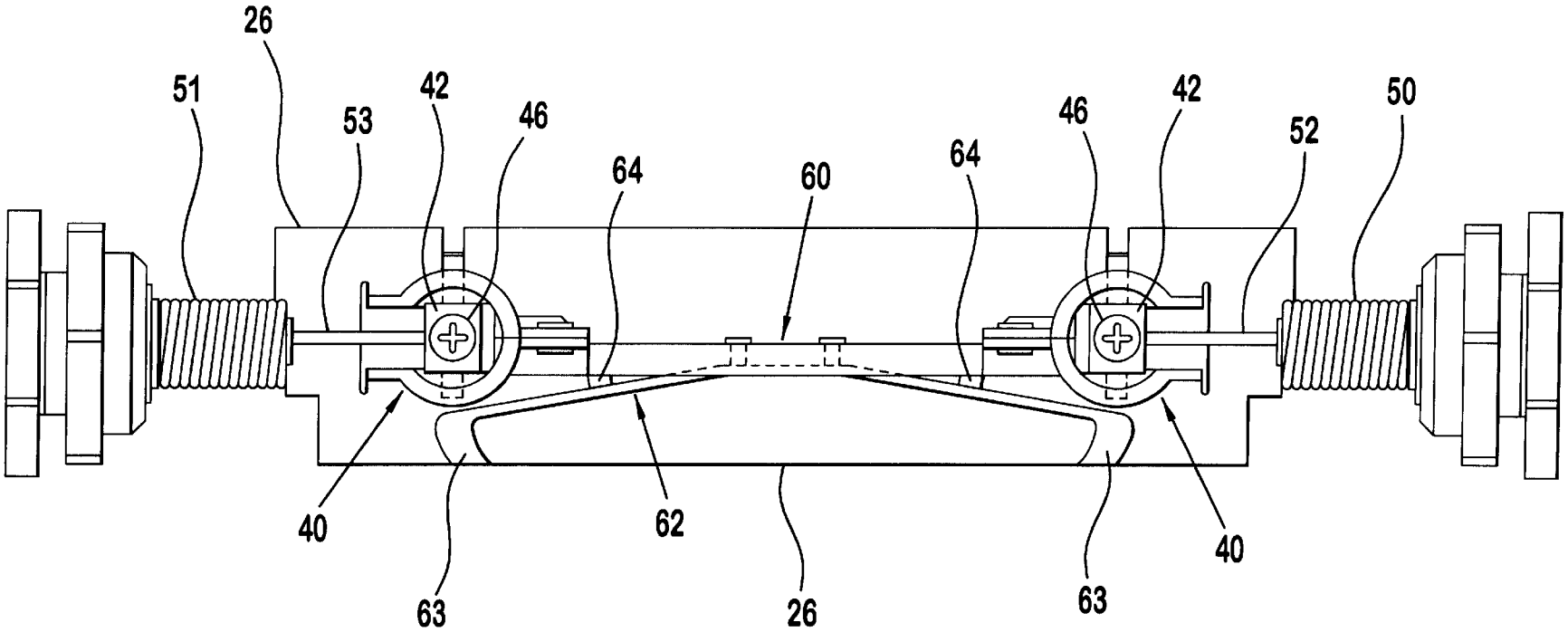
FIG. 7 PRIOR ART
FIG. 7 is a plan view of a tap having a bypass switch with the cover in place.
Figure 8:
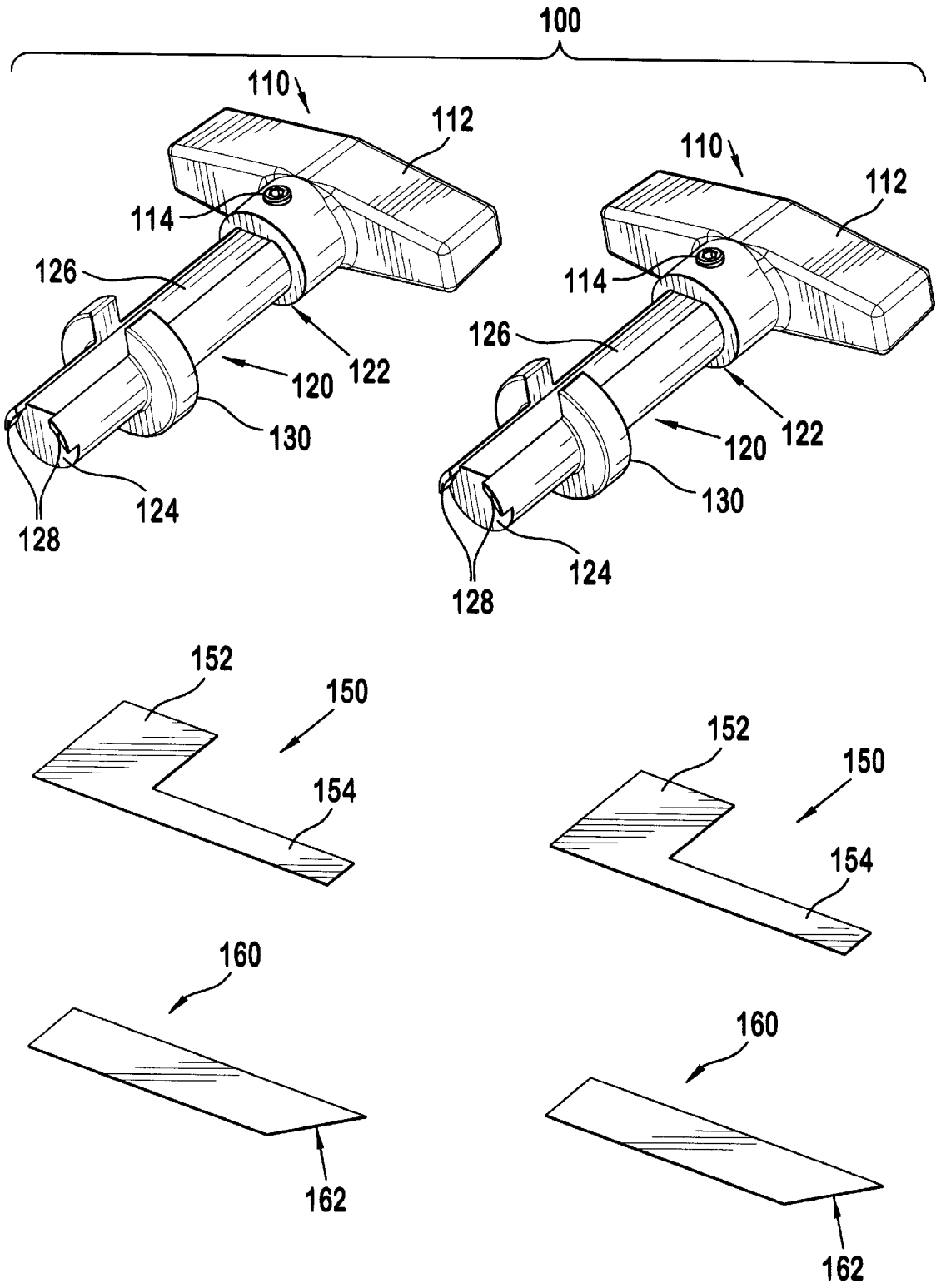
FIG. 8 is an isometric view of the preferred insulator insertion kit.

The preferred insulator insertion kit 100 is shown in FIG. 8 and comprises a pair of insertion tools 110, a pair of external insulator strips 150, and a pair of internal insulator strips 160.

Each insertion tool preferably includes a steel shaft 120 having a handle end 122 and an insertion end 124. The shaft 120 has a generally circular cross section with the exception of a slot 126 and is sized to permit the insertion end 124 to fit inside of a tap plug port 27. The handle end 122 includes a handle 112 which is attached with a set screw 114 or the like. The slot 126 extends from the handle 112 to the insertion end 124. A pair of projections 128 extend from the insertion end 124 adjacent to the edges of the slot 126. The projections 128 push against the terminal housing 40 to cause a slight space between it and the main housing 26, as will be described hereinafter. A shoulder 130 extends around the circumference of the shaft 120 from one edge of the slot 126 to the other such that the slot 126 extends through the shoulder 130.

Each external insulator strip 150 preferably has a flag shape with a handle portion 152 and an insertion portion 154. As will be described in greater detail hereinafter, the insertion portion 154 is demensioned to fit within the slot 126. The handle portion is wider than the insertion portion 154 to allow easier handling of the strip 150. Each internal insulator strip 160 is preferably rectangular in shape with one pointed end 162. All of the insulator strips 150, 160 are made from an insulative material, preferably mylar, and are approximately one one-hundredth (0.01) of an inch thick.

Having described the components of the insulator insertion kit 100, its use will now be described with reference to FIGS. 9–14. Since the kit 100 may be used with both straight through and 90 degree taps, FIGS. 9–14 show both arrangements. Operation with both types of taps 15 will generally be the same.

Figure 9:
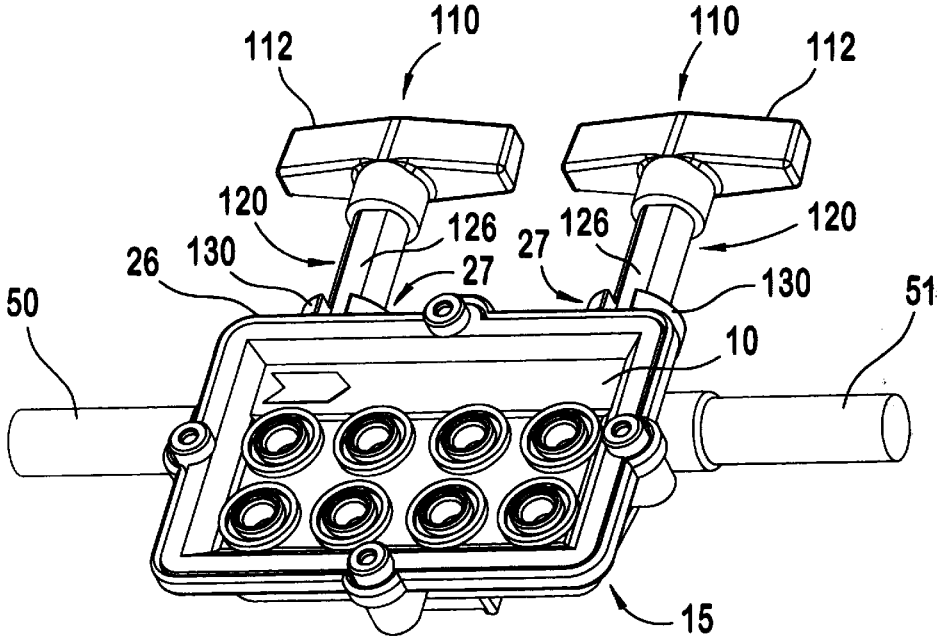
FIG. 9 is a cover surface isometric view of a tap with insulator tools inserted therein.
Figure 10:
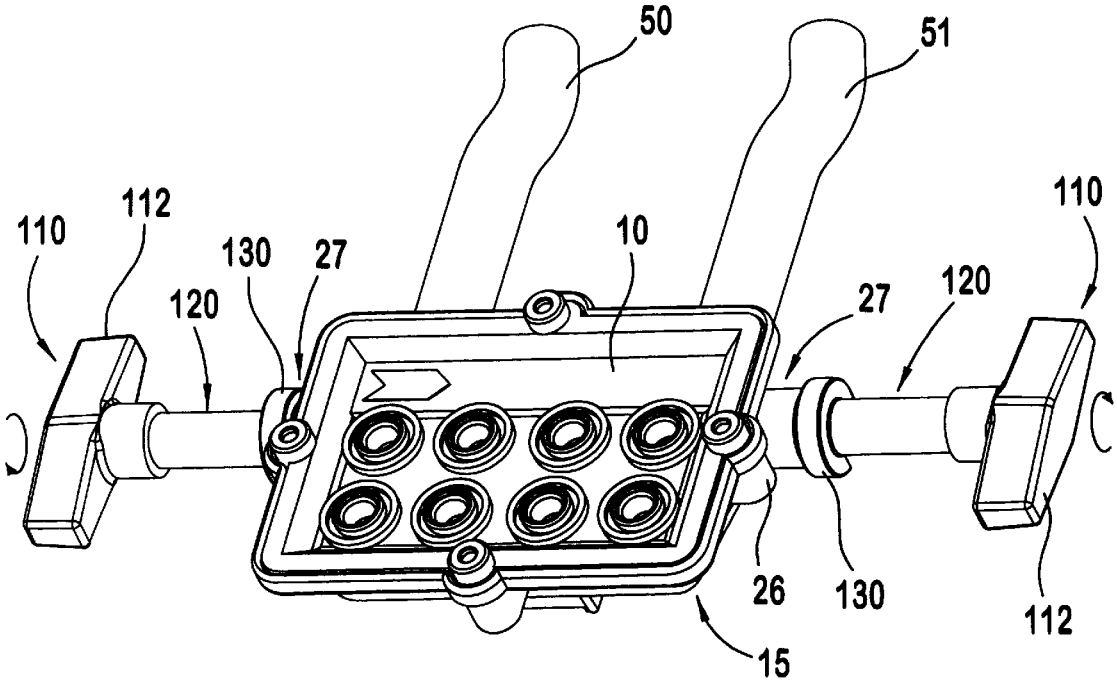
FIG. 10 is a cover surface isometric view of a tap with the insertion tools in a rotated position.
Figure 11:
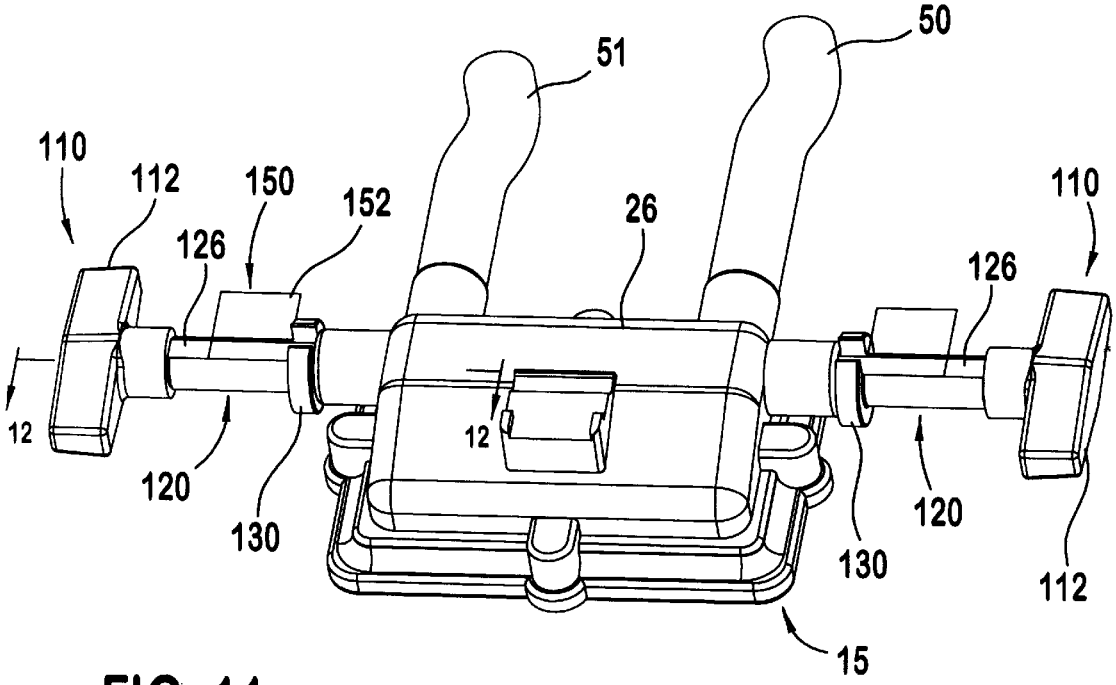
FIG. 11 is a housing surface isometric view of a tap with the insertion tools in a rotated position.

To prepare the tap 15 for service, the plugs 28 are removed from the plug ports 27. With the plugs 28 removed, an insertion tool 110 is inserted into each plug port 27 with the slot 126 facing towards the tap cover 10, as shown in FIG. 9. The insertion tool 110 is inserted until the shoulder 130 is adjacent to the tap housing 26. Referring to FIGS. 10 and 11, each insertion tool 110 is rotated 180 degrees until the slot 126 is facing opposite the tap cover 10. As each tool is rotated, it pushes between the terminal housing 40 and the main housing 26 to create a slight space therebetween.

Figure 12:
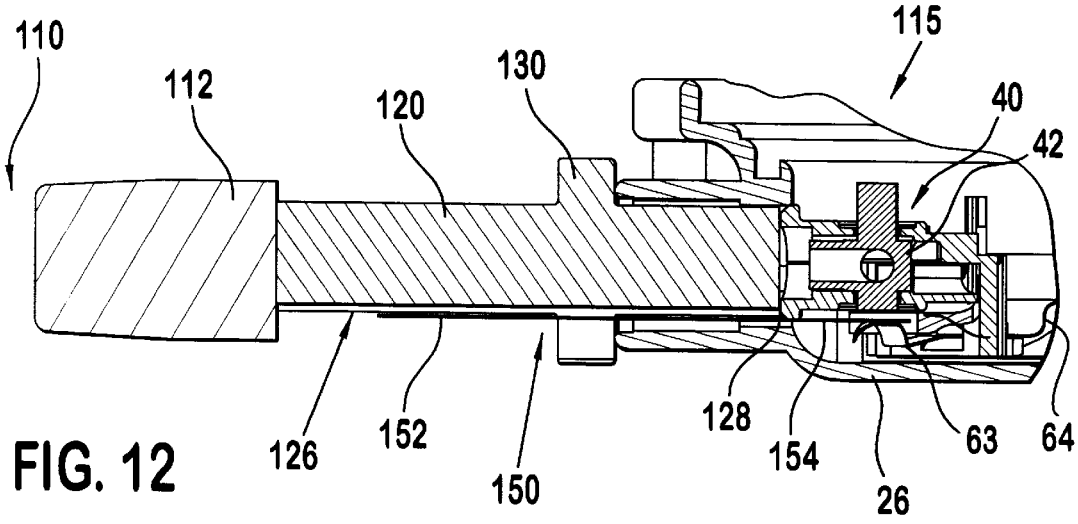
FIG. 12 is a section view taken along the line 12—12 in FIG. 11.
Figure 13:
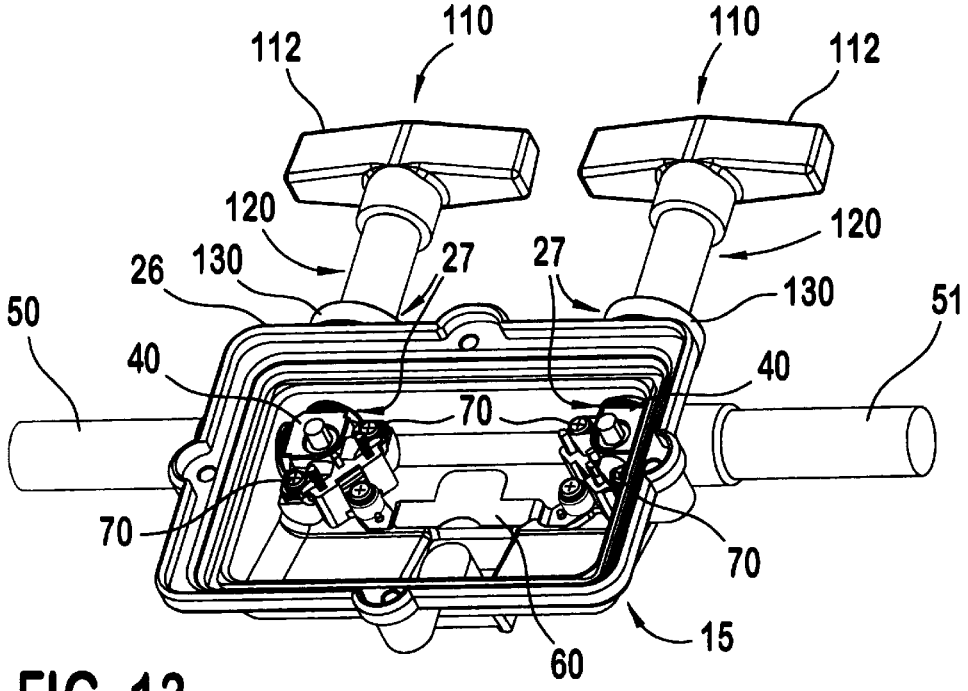
FIG. 13 is an isometric view of a tap with the cover removed.
Figure 14:
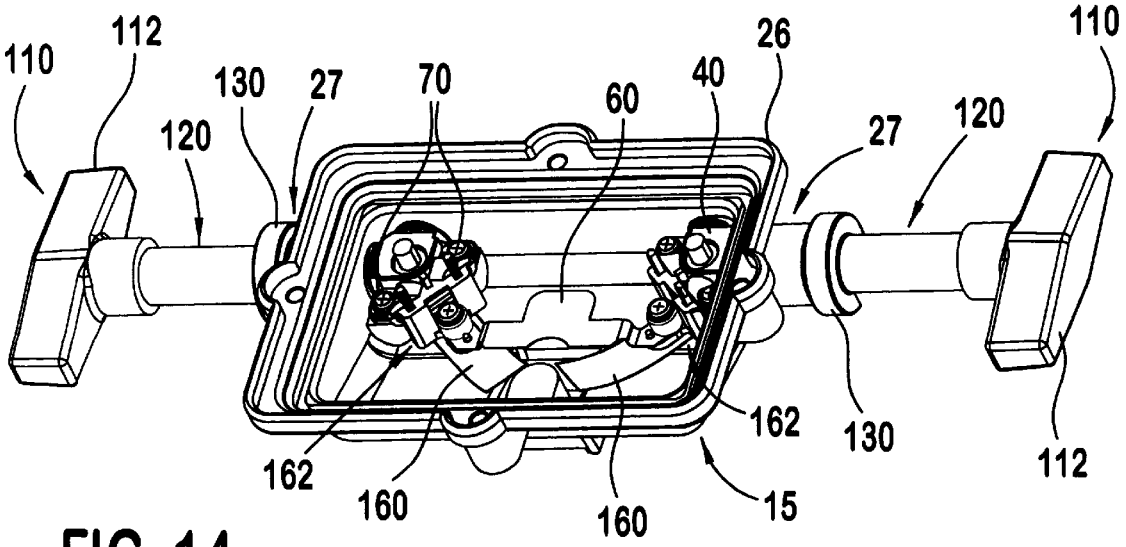
FIG. 14 is isometric view of a tap with the cover removed and internal insulator strips positioned therein.

With each tool 110 in this position, the external insulator strips are inserted as shown in FIGS. 11 and 12. The insertion portion 154 is aligned in the slot 126 and the handle portion 152 is used to slide the external insulator strip 150 into the tap 15 until the handle portion 152 abuts the shoulder 130. As shown in FIG. 12, with the external insulator strip 150 inserted, the insertion portion 154 extends into the tap 15 between the end of the leaf spring bypass conductor 63 and the contact terminal 42 and thereby prevents contact between the leaf spring contact end 63 and the terminal contact 42. Since the bypass switch 60 is prevented from making contact with the contact terminals 42, the technician can remove the tap cover 10 with a minimized chance of a short circuit.

With the tap cover 10 removed and the external insulator strips 150 preventing contact by the bypass switch 60, downline service is temporarily interrupted. To minimize this interruption, it is desired to remove the external insulator strips 150 as soon as possible. However, it is preferable to insert the internal insulator strips 160 before removal of the external strips 150. To insert the internal insulator strips 160, the terminal housing hold down screws 70 for each terminal housing 40 are loosened and a respective internal insulator strip 150 is positioned between the bypass switch ends 63 (not shown) and the tap housing 26. The angled end 162 allows the internal insulator strip 160 to be positioned into the corner of the tap 15. With the internal insulator strips 160 in position, the hold down screws 70 are tightened to maintain the strips 160 in position. The external insulator strips 150 and the insertion tools 110 are removed by performing the above steps in the opposite order. Removal of the external insulator strips 150 allows the bypass switch ends 63 to contact the contact terminals 42 and restore the downstream signal.

The tap 15 can now be serviced with an uninterrupted downstream signal. When service is completed, the tap cover 10 and plugs 28 are replaced. Since the internal insulator strips 160 do not interfere with the signal, they may be left in position after service is completed. The tap 15 will then be ready for future servicing without having to use the insertion tools 110 and external insulator strips 150.

While the present invention has been described in terms of the preferred embodiment, other variations which are within the scope of the invention as defined in the claims will be apparent to those skilled in the art.

What is claimed:

1. A kit for minimizing the chance of a short circuit during servicing of a signal tap, the kit comprising:

a pair of insertion tools, each insertion tool including first and second ends with a shaft therebetween and a slot extending along the shaft; and a pair of first, generally planar insulator strips, each strip having an insertion portion configured to be positionable within the shaft slot and moveable therealong to a position where a portion of the strip extends from the shaft slot whereby the strip conductively isolates a respective signal tap contact terminal.

2. The kit of claim 1 wherein each first insulator strip includes a handle portion attached to the insertion portion.

3. The kit of claim 2 wherein each first insulator strip has a flag shape.

4. The kit of claim 1 wherein each first insulator strip is manufactured from mylar.

5. The kit of claim 1 wherein each first insulator strip is about one one-hundredth of an inch thick.

6. The kit of claim 1 wherein each insertion tool includes a stop positioned between its ends to define a depth of insertion of the shaft.

7. The kit of claim 6 wherein the stop is a shoulder which extends around a portion of the shaft.

8. The kit of claim 1 wherein each shaft extends along an axis and each insertion tool includes a projection extending from one end of the shaft generally parallel to the respective axis.

9. The kit of claim 1 wherein each insertion tool includes a handle at one end of the shaft.

10. The kit of claim 1 further including a pair of second, generally planar insulator strips.

11. The kit of claim 10 wherein each second insulator strip has a generally rectangular shape with a point at a first end thereof.

12. The kit of claim 10 wherein each second insulator strip is manufactured from mylar.

13. The kit of claim 10 wherein each second insulator strip is about one one-hundredth of an inch thick.

14. The kit of claim 10 wherein each first insulator strip includes a handle portion attached to the insertion portion.

15. The kit of claim 14 wherein each first insulator strip has a flag shape.

16. The kit of claim 10 wherein each first insulator strip is manufactured from mylar.

17. The kit of claim 10 wherein each first insulator strip is about one one-hundredth of an inch thick.

18. The kit of claim 10 wherein each insertion tool includes a stop positioned between its ends to define a depth of insertion of the shaft.

19. The kit of claim 18 wherein the stop is a shoulder which extends around a portion of the shaft.

20. The kit of claim 10 wherein each shaft extends along an axis and each insertion tool includes a projection extending from one end of the shaft generally parallel to the respective axis.

21. The kit of claim 10 wherein each insertion tool includes a handle at one end of the shaft.

* * * * *